US006289554B1

(12) United States Patent
Wang

(10) Patent No.: US 6,289,554 B1
(45) Date of Patent: Sep. 18, 2001

(54) RETRACTABLE WHEEL DEVICE FOR SUITCASE

(76) Inventor: Tung Lung Wang, No. 240, San Min Road, Da Gia Town, Taichung Hsien (TW), 437

( * ) Notice: Subject to any disclaimer, the term of this patent is extended or adjusted under 35 U.S.C. 154(b) by 0 days.

(21) Appl. No.: 09/451,018

(22) Filed: Nov. 29, 1999

(51) Int. Cl.[7] ..... A45C 5/14

(52) U.S. Cl. ..... 16/34; 16/18 B; 190/18 A; 190/115; 280/37

(58) Field of Search ..... 16/34, 29, 18 B, 16/23; 190/18 A, 115, 39; 280/37, 43.1, 43.17

(56) References Cited

U.S. PATENT DOCUMENTS 2,853,732 * 9/1958 Matter ..... 16/34
4,588,203 * 5/1986 Anderson ..... 280/47.13 B
4,748,715 * 6/1988 Rice ..... 16/19
5,533,231 * 7/1996 Bai ..... 16/34
5,813,503 * 9/1998 Chang ..... 190/18 A

* cited by examiner

*Primary Examiner*—Anthony Knight
*Assistant Examiner*—Mark Williams
(74) *Attorney, Agent, or Firm*—Charles E. Baxley

(57) ABSTRACT

A wheel device is secured to a suitcase and has one or more oblong holes for slidably receiving a rod, a bracket pivotally secured to the casing for supporting a wheel, and a link pivotally coupling the bracket to the rod. A lever is coupled to the casing and engaged with the rod for moving the rod along the oblong hole of the casing. The bracket and the wheel may be moved outward and inward of the casing when the rod is moved to either of the ends of the oblong hole of the casing. The suitcase has a handle for actuating the lever to move the rod along the oblong hole.

12 Claims, 4 Drawing Sheets

RETRACTABLE WHEEL DEVICE FOR SUITCASE

BACKGROUND OF THE INVENTION

1. Field of the Invention

The present invention relates to a wheel device, and more particularly to a retractable wheel device for a suitcase.

2. Description of the Prior Art

Typical suitcases comprise one or more wheels that may be retracted and extended outward of the suitcase. However, the wheel devices comprise a complicated structure and may not be easily operated.

The present invention has arisen to mitigate and/or obviate the afore-described disadvantages of the conventional retractable wheels for suitcases.

SUMMARY OF THE INVENTION

The primary objective of the present invention is to provide a retractable wheel device for a suitcase including a simplified structure for allowing the wheel device to be easily manufactured and operated.

In accordance with one aspect of the invention, there is provided a wheel device for an object, the object including a housing secured therein and a handle slidably engaged therein, the wheel device comprises a casing secured to the housing of the object, the casing including at least one oblong hole formed therein and having two ends, a rod slidably received in the oblong hole of the casing and slidable between the ends of the oblong hole of the casing, a bracket pivotally secured to the casing at a pivot shaft, a wheel rotatably secured to the bracket and movable outward of the casing when the bracket is rotated relative to the casing about the pivot shaft, a link pivotally coupling the bracket to the rod, and means for moving the rod along the oblongs hole of the casing. The bracket is moved outward of the casing about the pivot shaft when the rod is moved to a first end of the ends of the oblong hole of the casing, and the bracket is moved inward of the casing when the rod is moved to a second end of the ends of the oblong hole of the casing.

The casing includes a first end, the bracket includes a first end pivotally secured to the first end of the casing at the pivot shaft, the bracket includes a second end having the wheel rotatably secured thereto and includes a middle portion, the link includes a first end pivotally coupled to the middle portion of the bracket and a second end coupled to the rod.

The casing includes a space formed therein for receiving the bracket and the wheel. The casing includes at least one flange extended therefrom and having the oblong hole formed therein for slidably receiving the rod. The casing includes an enlarged aperture formed therein and communicating with the oblong hole of the casing for receiving the rod.

The moving means includes a lever pivotally secured to the casing and engaged with the rod for moving the rod along the oblong hole of the casing. The lever includes a middle portion pivotally secured to the casing at a pivot pin, and includes a pulley rotatably secured to a first end thereof and engaged with the rod, and includes a second end having a hand grip provided thereon for actuating the pulley to move the rod along the oblong hole of the casing, the handle of the suitcase being provided for actuating the hand grip of the levers to move the rod along the oblong hole of the casing. A spring means is further provided for biasing the rod against the pivotally of the lever.

Further objectives and advantages of the present invention wilt become apparent from a careful reading of a detailed description provided hereinbelow, with appropriate reference to accompanying drawings.

DETAILED DESCRIPTION OF THE PREFERRED EMBODIMENT

Figure 2:
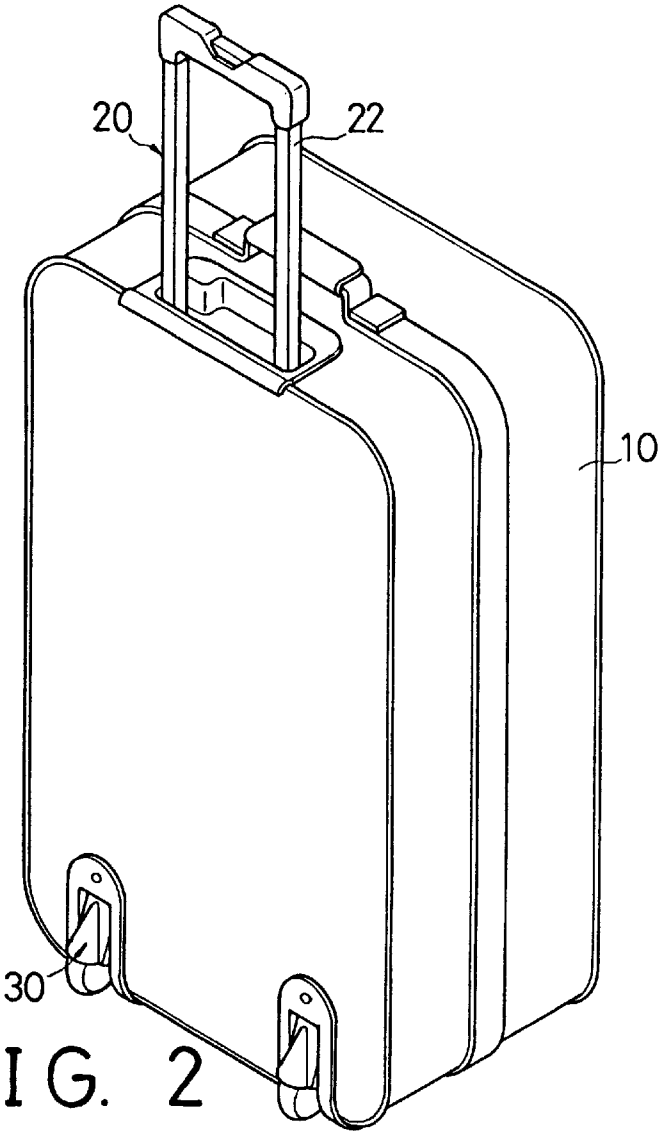
FIG. 2 is a perspective view of the retractable wheel device for the suitcase, in which the wheel device and the handle of the suitcase are both in an extended or open or working position.
Figure 1:
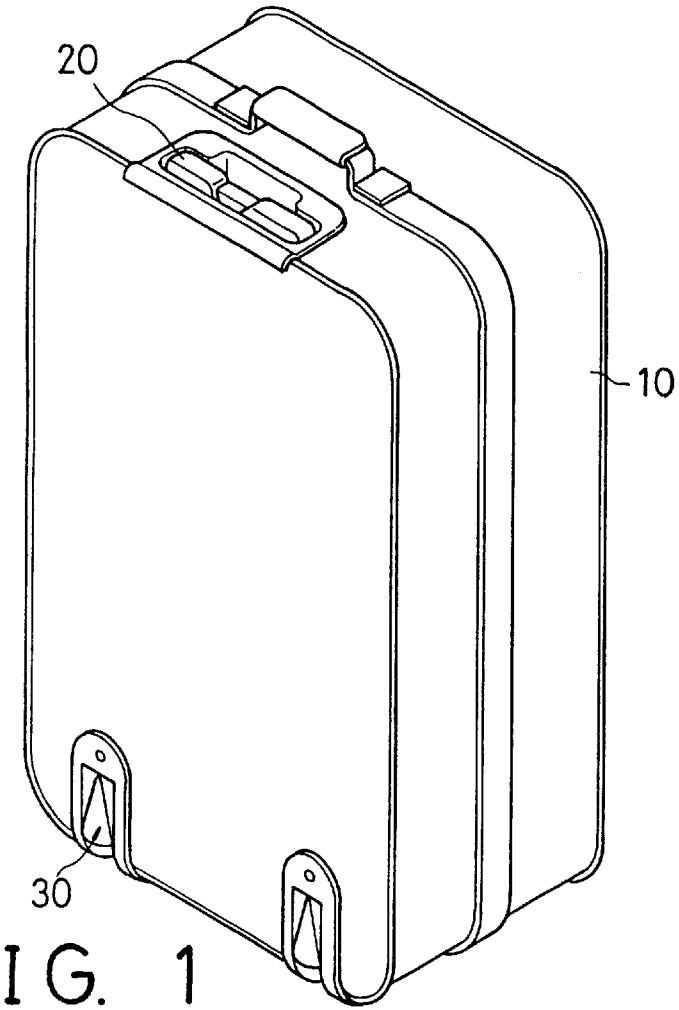
FIG. 1 is a perspective view of a suitcase having a retractable wheel device in accordance with the present invention, in which the wheel device and the handle of the suitcase are both in a folded or retracted position.
Figure 3:
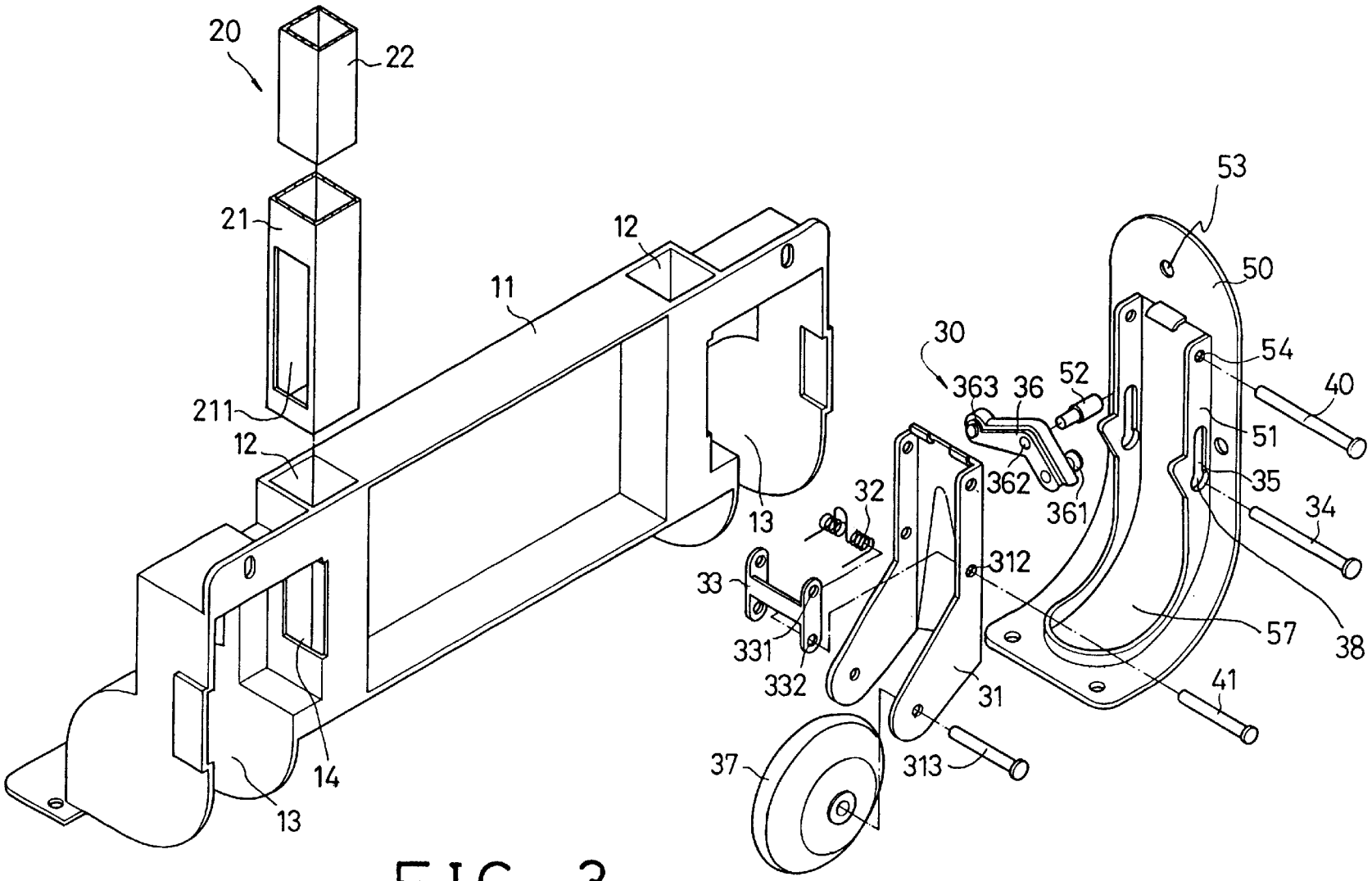
FIG. 3 is an exploded view of the wheel device.

Referring to the drawings, and initially to FIGS. 1 and 2, a retractable wheel device in accordance with the present invention is indicated by the reference numeral 30 and is provided for attaching onto an object, particularly for attaching onto a suitcase 10 or the like. The suitcase 10 includes a retractable handle 20 having one or more handlebars 22 slidably engaged therein. As shown in FIG. 3, the suitcase 10 includes a housing 11 secured therein, particularly secured in one side of the bottom portion thereof. The housing 11 includes one or more chambers 13 formed there in for receiving the wheel device 30, and includes one or more openings 12 formed therein and communicating with the chambers 13 with a passage 14 respectively. One or more tubes 21 are secured in the openings 12 respectively and each includes an orifice 211 communicating with the passage 14 and the chamber 13 of the housing 10. The tubes 21 are provided for slidably receiving the handlebars 21 respectively.

Figure 4:
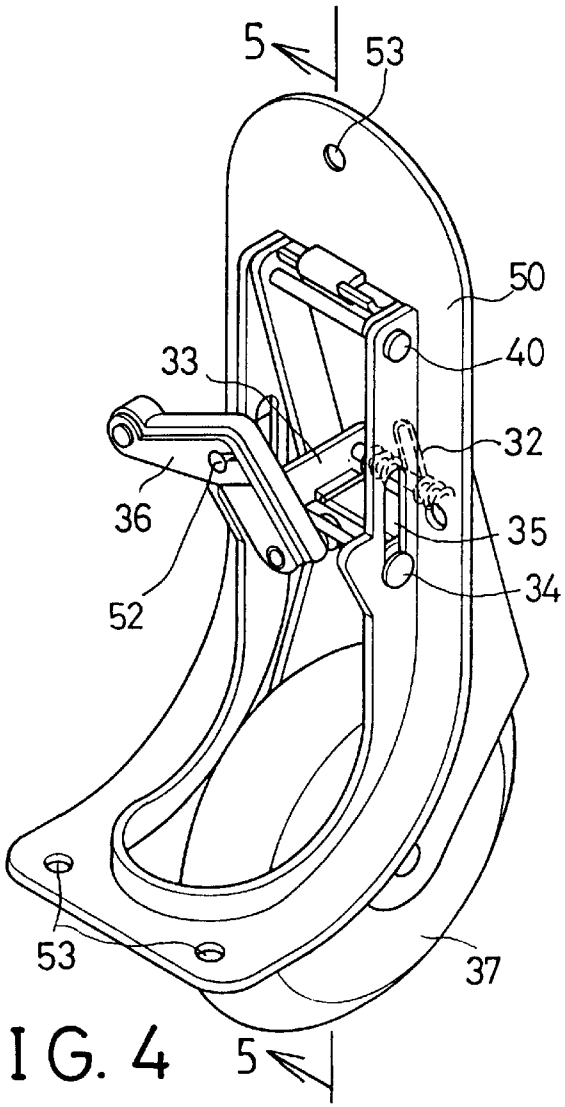
FIG. 4 is a perspective view of the wheel device, in which the wheel device is in the extended or working position.
Figure 5:
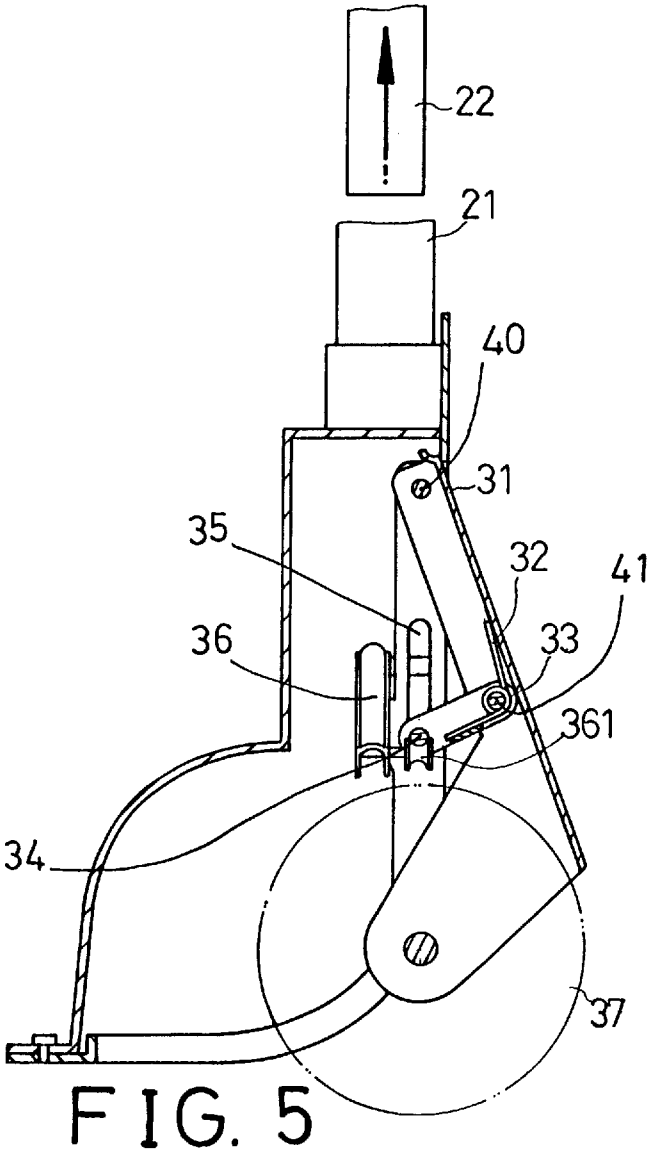
FIG. 5 is a cross sectional view taken along lines 5—5 of FIG. 4.

Referring next to FIGS. 3–5, the wheel devices 30 each includes a casting 50 having holes 53 formed therein for receiving fasteners which may secure the casing 50 to the housing 11 or directly to the suitcase 10. The casing 50 includes a pair of flanges 51 extended therefrom and a space 57 formed between the flanges 51. The flanges 51 of the casing 50 each includes an oblong hole 35 formed the middle portion thereof. A bracket 31 is received in the space 57 of the casing 50 and has an upper portion pivotally coupled to the casing 50 at a pivot shaft 40 which is engaged through the holes 54 that are formed in the upper portions of the flanges 51 of the casing 50. A wheel 37 is rotatably secured to the lower portion of the bracket 31 at a pivot axis 313, and may also be received in or extended outward of the casing 50 together with the bracket 31.

Figure 7:
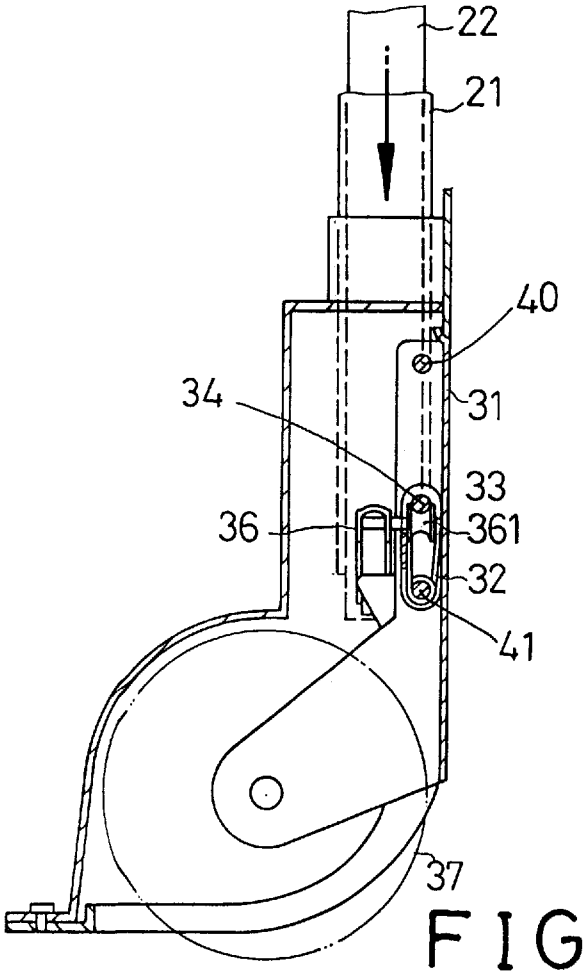
FIG. 7 is a cross sectional view taken along lines 7—7 of FIG. 6.

A link 33 has one end 332 pivotally secured to the middle portion of the bracket 31 at a pivot axle 41 which is engaged through the holes 312 that are formed in the middle portion of the bracket 31. A rod 34 is secured to the other end 331 of the link 33 and is slidably received in the oblong holes 35 of the flanges 51 of the casing 50. It is preferable that the flanges 51 of the casing 50 each includes a cavity or an enlarged aperture 38 (FIG. 3) Formed therein and communicating with the lower end of the oblong hole 35. A lever 36 has a middle portion 362 pivotally secured to the casing 50 at a pin 52 which may be secured to the casing 50, such as to the flange 51 of the casing 50 with fasteners or by welding processes. The lever 36 includes a roller or a pulley 361 secured to one end thereof and engaged with the rod 34 for moving the rod 34 along the oblong holes 35 of the flanges 51, and includes a hand grip 363 formed on the other end for engaging with the handlebars 22 of the handle 20. A spring 32 is engaged on the pivot axle 41 and engaged between the bracket 31 and the link 33 for biasing the other end 331 and/or the rod 34 to engage with the pulley 361 of the lever 36 (FIGS. 5, 7). The hand grip 363 of the lever 36 is extended inward of the opening 12 of the housing 11 via the passage 14 of the housing 11 and the orifice 211 of the tube 21 for allowing the hand grip 363 of the lever 36 to be engaged with and actuated by the handlebar 22.

In operation, as shown in FIGS. 2, 4, 5, when the handlebars 22 of the handle 20 are pulled outward of the suitcase 10 and are thus disengaged from the hand grip 363 of the lever 36, the spring 32 may bias the rod 34 downward along the oblong holes 35 to the bottom end of the oblong holes 35. The bracket 31 may be rotated about the pivot shaft 40 such that the wheel 37 may he moved outward of the casing 50. The bracket 31 and the link 33 form a stable structure for stably retaining the wheel 37 at the outward extending or working position. The rod 34 may be forced to engage with the enlarged apertures 38 of the flanges 51 for further stably retaining the rod 34 in the lower ends of the oblong holes 35 of the casing 50.

Figure 6:
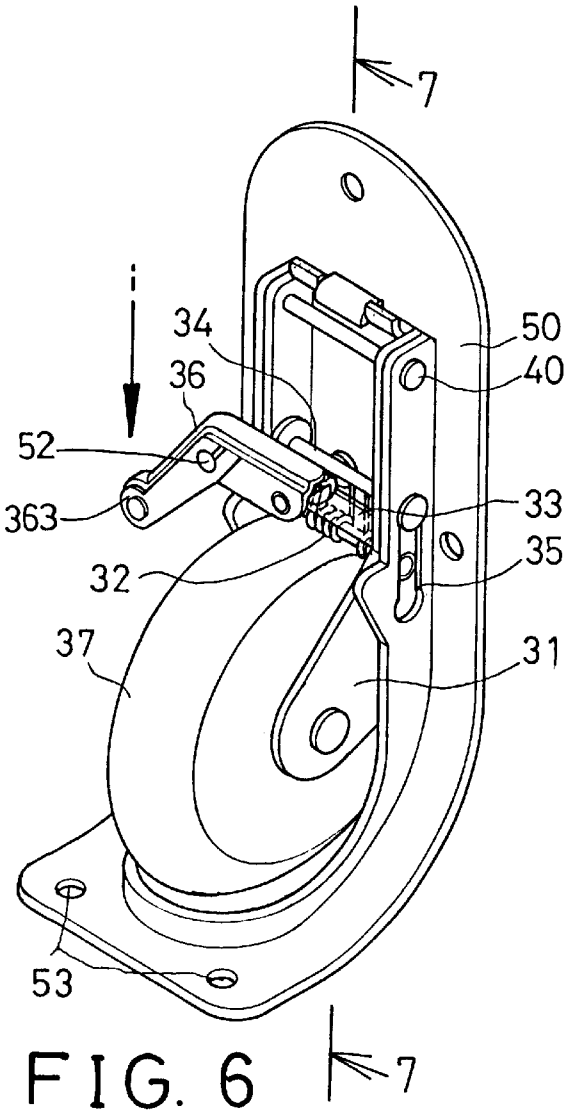
FIG. 6 is a perspective view of the wheel device, in which the wheel device is in the: retracted or folded position.

As shown in FIGS. 1, 6 and 7, when the handlebars 22 of the handle 20 are forced inward of the suitcase 10, the lower ends of the handlebars 22 may be moved inward of the tubes 21 and may be caused to engage with the hand grips 363 of the lever 36. The rod 34 may thus be moved upward along the oblong holes 35 to the upper end of the oblong holes 35. The bracket 31 may be rotated inward of the casing 50 about the pivot shaft 40 such that the wheel 37 may also be moved inward of the casing 50 to the retracted or folded position.

It is to be noted that the casing 50 and the bracket 31 and the wheel 37 may also be assembled together as a unit and may be attached to the other objects, such as the strollers, the hand carts, or any other objects that are required to be moved. The hand grip 363 of the lever 36 may be extended outward of the object and may be depressed by the user. The casing 50 may further includes a latch for locking the hand grip 363 at the folded position. Alternatively, the spring 32 may bias the rod 34 upward to the upper end of the oblong holes 35 of the casing 50, and the lever 36 may also be used to depress the rod 34 downward against the spring 32 for moving the bracket 31 and the wheel 37 outward of the casing 50. The wheel 37 may also be secured to the other portions of the bracket 31, such as the middle portion or the upper portion of the bracket. 31 when the lower or the middle portion of the bracket 31 is pivotally secured to the casing 50. When the wheels 37 are coupled together and moved in concert with each other, only one of the brackets 31 is required to be actuated by one of the handlebars 22.

Accordingly, the retractable wheel device for the suitcase in accordance with the present invention includes a simplified structure for allowing the wheel device to be easily manufactured and operated.

Although this invention has been described with a certain degree of particularity, it is to be understood that the present disclosure has been made bag way of example only and that numerous changes in the detailed construction and the combination and arrangement of parts may be resorted to without departing from the spirit and scope of the invention as hereinafter claimed.

I claim:

1. A wheel device comprising:

a casing including at least one oblong hole formed therein and having two ends, a rod slidably received in said at least one oblong hole of said casing and slidable between said ends of said at least one oblong hole of said casing, a bracket pivotally secured to said casing at a pivot shaft, a wheel rotatably secured to said bracket and movable outward of said casing when said bracket is rotated relative to said casing about said pivot shaft, a link pivotally coupling said bracket to said rod, and means for moving said rod along said at least one oblong hole of said casing, said moving means including a lever pivotally secured to said casing and engaged with said rod for moving said rod along said at least one oblong hole of said casing, sail lever including a middle portion pivotally secured to said casing at a pivot pin, and including a pulley rotatably secured to a first end thereof and engaged with said rod, and including a second end having a hind grip provided thereon for actuating said pulley to move said rod along said at least one oblong bole of said casing, said bracket being moved outward of said casing about said pivot shaft when said rod is moved to a first end of said ends of said at least one oblong hole of said casing, and said bracket being moved inward of said casing when said rod is moved to a second end of said ends of said at least one oblong hole of said casing.

2. The wheel device according to claim 1, wherein said casing includes a first end, said bracket includes a first end pivotally secured to said first end of said casing at said pivot shaft, said bracket includes a second end having said wheel rotatably secured thereto and includes a middle portion, said link includes a first end pivotally coupled to said middle portion of said bracket and a second end coupled to said rod.

3. The wheel device according to claim 1, wherein said casing includes a space formed therein for receiving said bracket and said wheel.

4. The wheel device according to claim 1, wherein said casing includes at least one flange extended therefrom and having said at least one oblong hole formed therein for slidably receiving said rod.

5. The wheel device according to claim 1, wherein said casing includes an enlarged aperture formed therein and communicating with said at least one oblong hole of said casing for receiving said rod.

6. The wheel device according to claim 1 further comprising means for biasing said rod against said pulley of said lever.

7. A wheel device for an object, the object including a housing secured therein and a handle slidably engaged therein, said wheel device comprising:

a casing secured to the housing of the object, said casing including at least one oblong hole formed therein and having two ends, a rod slidably received in said at least one oblong hole of said casing and slidable between said ends of said at least one oblong hole of said casing, a bracket pivotally secured to said casing at a pivot shaft, a wheel rotatably secured to said bracket and movable outward of said casing when said bracket is rotated relative to said casing about said pivot shaft, a link pivotally coupling said bracket to said rod, and means for moving said rod along said at least one oblong hole of said casing, said moving means including a lever pivotally secured to said casing and engaged with said rod for moving said rod along said at least one oblong hole of said casing, said lever including a middle portion pivotally secured to said casing at a pivot pin, and including a pulley rotatably secured to a first end thereof and engaged with said rod, and including a second end having a hand grip provided thereon for actuating said pulley to move said rod along said at least one oblong hole of said casing, the handle of the suitcase being provided for actuating said hand grip of said lever to move said rod along said at least one oblong hole of said casing, said bracket being moved outward of said casing about said pivot shaft when said rod is moved to a first end of said ends of said at least one oblong hole of said casing, and said bracket being moved inward of said casing when said rod is moved to a second end of said ends of said at least one oblong hole of said casing.

8. The wheel device according to claim 7, wherein said casing includes a first end, said bracket includes a first end pivotally secured to said first end of said casing at said pivot shaft, said bracket includes a second end having said wheel rotatably secured thereto and includes a middle portion, said link includes a first end pivotally coupled to said middle portion of said bracket and a second end coupled to said rod.

9. The wheel device according to claim 7, wherein said casing includes a space formed therein for receiving said bracket and said wheel.

10. The wheel device according to claim 7, wherein said casing includes at least one flange extended therefrom and having said at least one oblong hole formed therein for slidably receiving said rod.

11. The wheel device according to claim 7, wherein said casing includes an enlarged aperture formed therein and communicating with said at least one oblong hole of said casing for receiving said rod.

12. The wheel device according to claim 7 further comprising means for biasing said rod against said pulley of said lever.

* * * * *